US006186891B1

(12) United States Patent
D'Andrea

(10) Patent No.: US 6,186,891 B1
(45) Date of Patent: Feb. 13, 2001

(54) ASSEMBLY FOR REDUCING ENERGY COSTS AND RESTRICTING THE ENTRY OF CONTAMINANTS INTO A CONTROLLED ENVIRONMENT ROOM

(76) Inventor: Anthony D'Andrea, 14301 Bedford Ct., Davie, FL (US) 33325

( * ) Notice: Under 35 U.S.C. 154(b), the term of this patent shall be extended for 0 days.

(21) Appl. No.: 09/315,397

(22) Filed: May 20, 1999

(51) Int. Cl.[7] ..... B01L 1/04
(52) U.S. Cl. ..... 454/187; 454/50; 454/51
(58) Field of Search ..... 454/50, 51, 52, 454/255, 259, 187, 188, 189

(56) References Cited

U.S. PATENT DOCUMENTS

| | | | | |
|---|---|---|---|---|
| 4,304,224 | * | 12/1981 | Fortney | 454/187 |
| 4,676,144 | * | 6/1987 | Smith, III | 454/187 |
| 4,850,268 | * | 7/1989 | Saito et al. | 454/187 |
| 5,316,518 | * | 5/1994 | Challenger | 454/187 |
| 5,704,833 | * | 1/1998 | Reix et al. | 454/187 |

* cited by examiner

*Primary Examiner*—Pamela Wilson
*Assistant Examiner*—Derek S. Boles
(74) *Attorney, Agent, or Firm*—Malloy & Malloy, P.A.

(57) ABSTRACT

A regulating assembly for a controlled environment room including one or more work product openings comprising a positive pressure air chamber mounted in direct fluid communication with each of the work product openings and an airsupply assembly connected to each of the air chambers so as to supply a sufficient quantity of air thereto, such that a predetermined positive air pressure is created in each of the air chambers. The predetermined positive is at least minimally greater than the air pressure on the interior of the controlled environment room. The greater air pressure in each of the air chambers, results in concurrent paths of air flow directed from each of the air chambers into the interior of the controlled room and simultaneously outward therefrom to the surrounding environment. Contaminant material is thereby restricted from entering the interior of the controlled room through either of the work product openings and conditioned air is prevented or significantly restricted from escaping from the controlled environment rooms through the work product openings. Significant quantities of "make-up" air supplied to the controlled room are not required which results in substantial savings in energy costs.

22 Claims, 4 Drawing Sheets

ASSEMBLY FOR REDUCING ENERGY COSTS AND RESTRICTING THE ENTRY OF CONTAMINANTS INTO A CONTROLLED ENVIRONMENT ROOM

BACKGROUND OF THE INVENTION

1. Field of the Invention

This invention is directed to an assembly for reducing the cost of energy required to maintain the environment within an industrial enclosure known as a controlled environment room, particularly but not exclusively, of the type designed for applying a powder coating to a plurality of work products disposed on a conveyer which continuously passes through the controlled environment room during the coating process. The assembly of the present invention is also directed to significantly restricting, if not prohibiting, the entry of particulate material or like contaminants into the controlled environment room, by subjecting the continuously moving work products carried on the conveyor, as well as the interior of the controlled environment room, to concurrent paths of positively pressurized, air flow. The assembly of the present invention thereby minimizes the escape of "conditioned" air from the controlled room and significantly reduces the energy costs associated with its replacement.

2. Description of the Related Art

The use of enclosures having a controlled environment is well known in industry and are often referred to as controlled environment rooms or controlled rooms. Such controlled rooms may be designed and structurally adapted for a wide variety of applications. However, common to virtually all of the various industrial applications is the attempted controlling of the interior environment of such controlled rooms or enclosures to the extent of controlling temperature, humidity, cleanliness and, in certain instances interior air pressure. While controlled environment rooms of the type referred to herein may include clean rooms, and even large, industrial size coolers or freezers, one common application of such controlled rooms is the application of powder coatings and/or paint, utilizing an electrostatic charge applied to each of a plurality of work products which may be mounted on a conveyor which continuously moves conveyor, with an opposite electrostatic charge provided to the powder coating or paint so as to facilitate application onto the work products. In this and other types of applications it is common for the controlled environment room to include at least two spaced apart and substantially opposing openings through which the moving conveyor, supporting the plurality of work products, passes. One of these openings is disposed so as to permit the entry of the plurality of work products into the controlled environment room and while the other opening is disposed to permit the exit of the work products from the controlled room, after the application of the powder coating thereon. In order to maintain the high quality standards expected, when products are processed in the above described manner, it is important that contaminant material from the environment or atmosphere surrounding the controlled room be restricted, if not prohibited, from entering the interior of the room, and thereby, interfering with the powder coating process. In addition, the maintenance of the temperature and humidity on the interior of the controlled room within certain preset or predetermined parameters is important, particularly because of the application of the electrostatic charge on the plurality of work products. In order to accomplish the required objectives in maintaining the interior of such processing rooms within acceptable industrial standards, air conditioning assemblies are used to deliver significant quantities of treated air to the interior of the controlled roms. The air conditioning assemblies also serve to maintain the temperature and humidity of such delivered air within the acceptable parameters. In addition, in an effort to reduce the entry of contaminants into the controlled room, the air pressure within the interior of such controlled rooms is maintained at a significantly greater level than the atmospheric pressure of the surrounding environment. Because of this increased interior air pressure, a continuous flow or quantity of air will pass out through each of the aforementioned work product openings. Contaminant material is, thereby, prevented or significantly restricted from entering through these work product openings, during the passage of the plurality of work products into and out of the interior of the controlled room. The recognized industry standard for the discharge of air from the interior of the controlled room is substantially one hundred and twenty (120') feet per minute. As such, a large volume of the treated and conditioned air being supplied to the interior of the controlled room by an air conditioning and treatment assembly is lost to the surrounding area or environment, on a continuing basis, and accordingly, in order to maintain an acceptable, high quality standard for powder coating applications, an additional supply of "make-up" air must be continuously returned to the controlled room in order to control the environment therein. However, the "make-up" air must also be treated and/or conditioned to have the same temperature and humidity characteristics as the air which is being continuously lost from the controlled room through the aforementioned work product openings. Therefore, in addition, to the problems associated with restricting the entry of contaminant material into the interior of the controlled rooms, an additional problem in this industry is the high cost involved in supplying the voluminous amounts of conditioned "make-up" air back to the interior of the controlled room.

In order to avoid problems of the type set forth above, attempts have been made to develop energy conservation systems for controlled environment rooms, particularly the type designed for powder coating applications of a plurality of work products. Specifically, in order to reduce the expense involved in returning "make-up" air to the interior of the controlled rooms, known attempts have utilized the application of negative air pressure to the areas immediately exterior of the work product openings in a controlled room. For example, one known assembly routes the air exiting the interior of the controlled room through such work product openings to a recycling assembly, which then reconditions the air and returns it to the interior of the room, instead of utilizing newly conditioned, "make-up" air. A drawback associated with this assembly, however, is that provision of the negative air pressure to the areas immediately exterior of the work product openings tends to accelerate the passage of contaminants, in the untreated air from the surrounding environment, toward the interior of the controlled room. More specifically, the existence of a negative air pressure is thought to have the effect of greatly accelerating the entry of contaminants in untreated air into an area where it is directly exposed to the work products, immediately prior to their entry into the interior of the controlled room, where the powder coating application would occur. This exposure to contaminated air at an accelerated rate and in greater quantities, could have the effect of depositing additional amounts of contaminants directly on the work products, just before they enter the controlled room. It could also have the effect of interfering with the application of an electrostatic charge to the work products, which may be needed in order to achieve a proper powder or paint coating on them as they pass through the controlled room. In addition, subsequent to an application of powder coating or paint within the controlled room, this known type of assembly would subject the work products again to the exposure of an accelerated flow of contaminated air as they exit through the corresponding work product opening. If, in fact, the drying or curing stage of the powder coating process was not complete at this point, such exposure could result in the depositing of additional contaminants thereon and in the forced removal of the powder coating and/or paint applied to the work product. Alternatively, if the application of the electrostatic charge to the work products was interfered with upon their entry into the controlled room, the quality of the coating would be lower and the drying or curing stage might take longer. In addition, the existence of the negative air pressure in the described, known assembly would appear to greatly increase the amount of conditioned air which exits the interior of the controlled room. Even if this increased volume of air is recycled, it must still have to be at least partially treated or conditioned again in order to raise or lower it to required temperature and humidity characteristics before it could be returned to the interior of the controlled room. The energy costs would, therefore, probably be increased because of the large quantity of recycled "make-up" air being treated and returned to the controlled room.

As set forth above, an important concern associated with controlled environment rooms such as large coolers or freezers is the escape of the conditioned air from the interior of the cooler/freezer rather than the entry of contaminants through a work product or other access opening formed therein. In this category of controlled environment rooms, it is well understood that the reduction of temperature and control of humidity within industrial size coolers/freezers involves extremely high energy costs. Accordingly, the escape of the conditioned air from such controlled rooms involves having to supply "make-up" air which has the same, significantly reduced temperature characteristics, and a significant increase in energy costs associated therewith. Attempts to reduce the escape of the conditioned air from the interior of this type of controlled room include the provision of plastic or like material curtains comprising a plurality of "ribbons" or "stringers" at the access opening to the cooler or freezer, which allows both personnel and products to pass therethrough. However, it is well known that such curtain-type of structures have been found to be less effective than desired at controlling the escape of air through the openings or portals which they attempt to cover. Another attempt to reduce the escape of conditioned air from the interior of such controlled rooms involve the use of "air curtains," which result in little or no savings in the energy cost associated with their operation for continuous or prolonged periods.

Therefore, there is a recognized need in the art associated with the utilization of controlled environment rooms or like enclosures for an improved assembly which can restrict, if not prevent, the entry of contaminated material into the interior thereof. Any such improved assembly should also be directed to reducing the energy costs associated with the maintenance of temperature, humidity, cleanliness and air pressure within the interior of such controlled rooms, such as by significantly reducing the amount of conditioned air escaping from the interior of the controlled rooms, and thereby, effectively eliminating the need for "make-up" air.

SUMMARY OF THE INVENTION

The present invention is directed to a regulating assembly intended for use with a controlled environment room or like type of enclosure, particularly but not exclusively, of the type structured for the application of powder coating and/or paint to a plurality of work products which are movably supported on a conveyor or other device which passes them through the controlled environment room. Usually, in this type of application, a conveyor removably supports a plurality of work products in spaced relation to one another and continuously moves through the controlled environment room. In the controlled room, a powder coating, such as paint or the like is applied to the work products, with an electrostatic charge sometimes being applied to the work products in order to facilitate the adherence of the powder coating to the exterior surface thereof. While the regulating assembly of the present invention is described with primary reference to a controlled environment enclosure or room structured to accomplish the aforementioned, powder coating application, it could be readily adapted to other controlled environment rooms such as clean rooms, large or industrial sized coolers or freezers, and other controlled enclosures which may vary in design and in overall structural configuration, dependant upon their particular application.

The regulating assembly of the present invention, in each of the preferred embodiments to be described in greater detail hereinafter, is designed to reduce or eliminate contaminant material from entering into the interior of the controlled environment room or from otherwise contacting, and thereby contaminating, the plurality of work products as they enter or exit the interior of the controlled room. The present invention is also designed to significantly reduce the cost associated with conditioning or treating the air within the interior of the controlled room by reducing the amount of "make-up" air which must be supplied in order to replace any of the conditioned air which escapes through work product openings or other access openings formed in the controlled room.

More specifically, in conventional or known controlled environment rooms, one or more work product openings are provided in cooperative disposition relative to one another, so as to allow for the entry and exit of the plurality of work products. The regulating assembly of the present invention preferably comprises an air chamber mounted in contiguous relation to each of the work product openings formed in the controlled environment room, and further, preferably such that the interior of the individual air chambers are disposed in direct fluid communication with both the interior of the controlled room, as well as the area or environment surrounding the controlled room. Each of the air chambers are associated with an air supply assembly which channels air under positive pressure into the interior of the respective air chambers at a sufficient rate or in sufficient quantities to maintain at least a predetermined positive air pressure within the individual air chambers. Such predetermined positive air pressure should be at least minimally greater than the air pressure within the interior of the controlled room, and also, greater than the ambient air pressure of the surrounding area to the exterior of the controlled environment room. Further, the predetermined positive air pressure maintained within each of the one or more air chambers should be sufficient to establish two concurrent paths of air flow which simultaneously pass into the interior of the controlled room and to the surrounding area on the exterior of the controlled room. To establish these concurrent paths of positive air flow, each of the air chambers is preferably provided with a first passage and a second passage. Both the first and second passages of each air chamber is dimensioned and configured to allow travel therethrough of the moving conveyor as well as the plurality of work products supported thereby. The first passage is preferably disposed between the interior of each air chamber and the exterior, surrounding environment. The second passage is preferably disposed in direct, contiguous relation to a correspondingly positioned, work product opening formed in the controlled room. The concurrent paths of positive air flow passing simultaneously through the first and second passages in each air chamber, will prevent or significantly reduce the entry of contaminants into the interior of the respective air chambers since air is flowing from each air chamber through the first passage to the exterior environment. In addition, air will generally be prevented from passing from the interior of the controlled room into either of the air chambers due to positive air flow in the reverse direction, through the second passage and the correspondingly positioned, work product opening formed respectively in the air chamber and the controlled room. As set forth above though, the present invention is also designed to significantly reduce the quantity of air escaping from the interior of the controlled room, thereby significantly reducing the cost associated with maintaining the temperature, humidity, air pressure, etc. of the air on the interior of the controlled room.

Other structural features of the present invention, to be described in greater detail hereinafter, include the provision of a distribution assembly which may comprise a diffusion structure. The distribution assembly serves to distribute air from the aforementioned air supply assembly substantially evenly throughout the interior of each of the air chambers. This facilitates the formation and direction of the concurrent paths of positive air flowing simultaneously to the exterior of the controlled room, through the first passage of each air chamber, and into the interior of the controlled room through the second passage of each air chamber.

Therefore, it is a primary object of the present invention to provide a regulating assembly for controlling the entry of contaminants into a controlled environment room, particularly but not exclusively, of the type structurally designed to accomplish the application of a powder coating to a plurality of work products being passed therethrough, such as on a conveyor.

Another primary object of the present invention is to reduce the cost and expense associated with maintaining a predetermined temperature, humidity, air pressure, etc. within the interior of a controlled environment room.

Yet another important object of the present invention is to provide a positive pressure air chamber in direct fluid communication with a work product opening formed in a controlled environment room, and thereby, substantially isolate the work products passing into and out of the controlled room from contaminant material exiting in the surrounding environment.

Still another object of the present invention is to provide a regulating assembly which incorporates a plurality of positive air pressure chambers equal in number to that of the number of work product openings formed in a controlled environment room, wherein the positive pressure air chambers are disposed and structured to eliminate or significantly reduce the exposure of work product to contaminant material immediately before and after being processed on the interior of a controlled environment room.

It is also an important object of the present invention to provide a regulating assembly which includes a positive air pressure chamber associated with each work product opening formed in a controlled environment room, and supply each of the air pressure chambers with a sufficient quantity of pressurized air to maintain at least a minimum, predetermined, positive air pressure within the air chambers sufficient to establish concurrent paths of air flow from the interior of the respective air chambers into the interior of the controlled room, and simultaneously into the surrounding environment from which the work product enters, as it passes into the controlled room.

Yet another object of the present invention is to provide a regulating assembly which is readily adaptable for use with existing controlled environment rooms structurally designed to accomplish any one of a variety of different practical applications or which may be constructed as part of an original environment controlled room.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
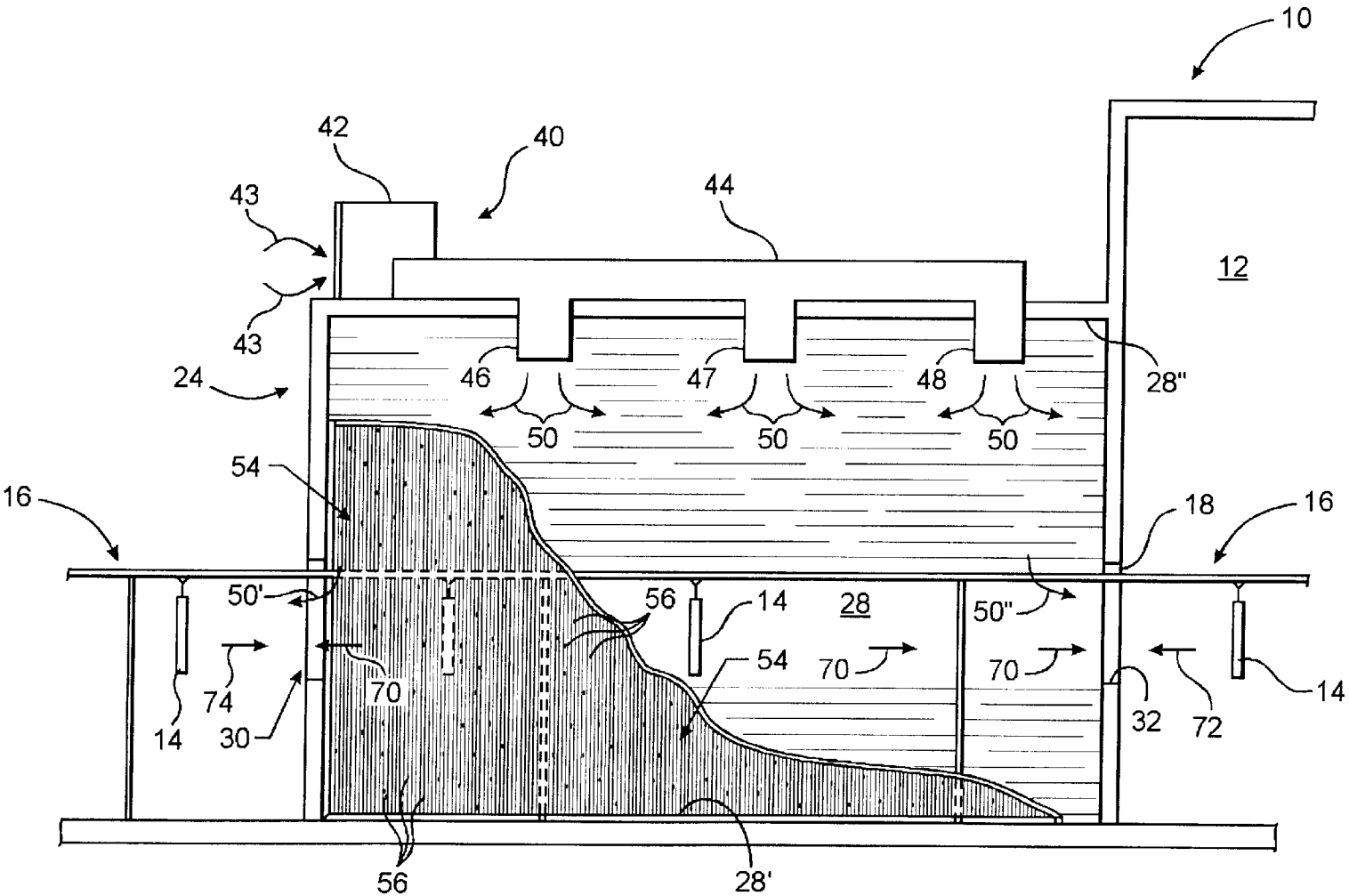
FIG. 1 is a side elevation view in partial cutaway showing interior portions of one air chamber associated with the regulating assembly of the present invention.

As shown in the accompanying Figures, the present invention is directed towards a regulating assembly, generally indicated by reference numeral 10, which is designed for use with an industrial enclosure known as a controlled environment room, including an interior 12, in which any one of a variety of industrial applications or processes may be accomplished. Based upon the particular intended application for which the controlled room 10 is designed, its size and configuration may, of course, vary. While the present invention will be described with particular reference to an environment controlled room 10 intended for the application of a powder coating onto a plurality of work products, it should be emphasized that it is within the intended spirit and scope of the present invention for the regulating assembly, to be described hereinafter, to be used with any one of a variety of different environment controlled rooms, each of which may be designed for a different or other type of application. For example, the controlled room 10 may also be of the type designed for use as a clean room, a large walk-in type of cooler and/or freezer, or for a variety of other uses and/or applications.

Figure 2:
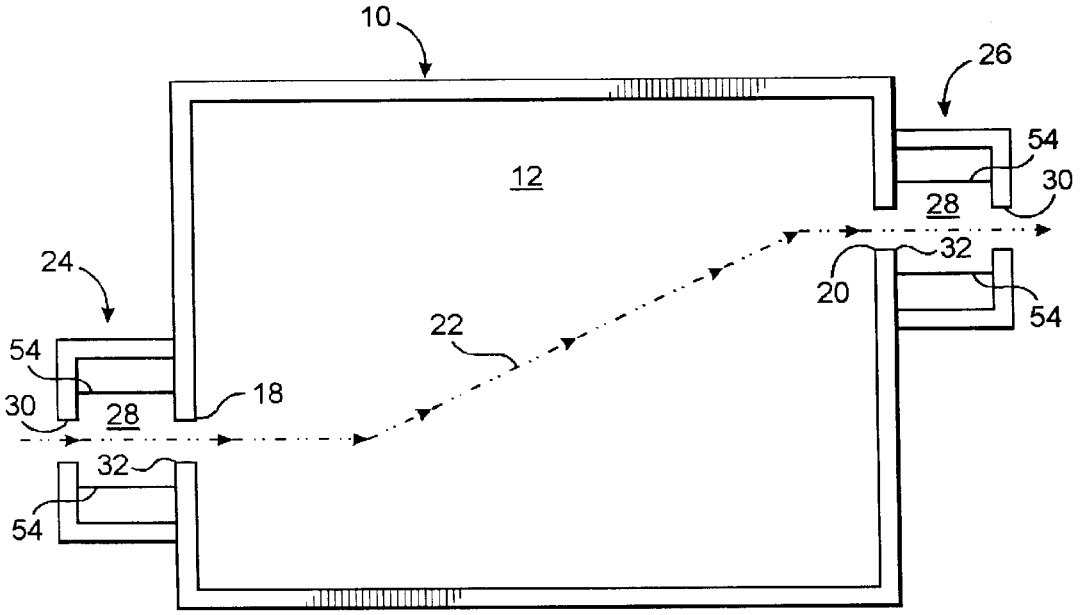
FIG. 2 is a top plan view of the regulating assembly of the present invention in a preferred embodiment.

With reference now to FIG. 1, it is intended that the controlled room 10 will have a specifically controlled environment maintained on the interior 12, in terms of the temperature, humidity and pressure of the air contained therein being regulated, such as for instance, to facilitate the application of powder coatings on a plurality work products 14. Each of the work products 14 are mounted in spaced relation to one another on or by a supporting and continuously moving conveyor assembly, generally indicating as 16. As shown in FIG. 1, the conveyor assembly 16 can be of an overhead type designed to carry a plurality of work products, although the conveyor assembly 16, as well as the work products 14, may, of course, assume a variety of different structural configurations and sizes, as might be dependent upon the intended use of the work products 14. As shown in FIGS. 1 and 2, the controlled room 10 includes at least one, but preferably, two spaced apart work product openings 18 and 20, through which the various work products 14, being movably supported on the conveyor assembly 16, pass into and out of the interior 12, where they are processed. As shown in FIG. 2, path 22 of the conveyor assembly 16 may vary on the interior 12 as it travels between the work product openings 18 and 20. The configuration of path 22 is, of course, determinative of the relative location of the work product openings 18 and 20.

The regulating assembly of the present invention comprises one or more air chambers 24 and 26, which preferably, but not necessarily, are equal in number to the number of work product openings, such as openings 18 and 20 shown in FIG. 2. The one or more air chambers are preferably mounted on the exterior of the controlled environment room 10 in direct fluid communication with both the interior 12, as well as the surrounding atmosphere or environment, on the exterior of the controlled room 10 and each of the air chambers 24 and 26. Each of the air chambers 24 and 26 includes an interior 28 and spaced apart passages 30 and 32 disposed in fluid communication with the exterior of the air chamber interior 28, as shown in FIG. 2. More specifically, each of the air chambers 24 and 26 includes a first passage 30 disposed in established fluid flow communication between the chamber interior 28 and the surrounding area located exteriorly of both the respective air chambers 24 and 26, as well as the controlled room 10. Each of the air chambers 24 and 26 also includes a second passage 32 disposed to establish fluid communication between the interior 28 of each of the air chambers 24 and 26 and the interior 12 of the controlled room 10. The second passages 32 of each air chamber 24 and 26 are preferably disposed in immediately adjacent and/or contiguous relation to the respective work product openings 18 and 20, as best disclosed in FIG. 2. The first and second passages 30 and 32 are also dimensioned and configured to allow passage therethrough of the conveyor assembly 16, as well as plurality of work products 14 movably supported thereon.

With primary reference to FIGS. 1 through 5, each of the air chambers 24 and 26 is associated with an air supply assembly generally indicated as 40. While the air supply assembly 40 will be discussed with specific reference to the air chamber 24, as disclosed in FIG. 1, it should be emphasized that an air supply assembly 40 is directly associated with each of the air chambers 24 and 26. Further, each of such air chambers 24 and 26 may have separate air supply assemblies or may be supplied with air, under positive pressure from a common air supply assembly. Again with reference to FIG. 1, the air supply assembly 40 includes a blower assembly 42 receiving induced air 43 and which may or may not also include additional air conditioning facilities to regulate the temperature and humidity of the air flowing into the interior 28 of each of the air chambers 24 and 26. The air supply assembly 40 also includes ducting 44 which may assume a variety of configurations and/or dimensions dependent upon the size and configuration of the interior 28 of each of the air chambers 24 and 26. An air distribution assembly comprising at least one, but in the preferred embodiment of FIGS. 1 through 5, a plurality of air outlets 46, 47 and 48 are connected and/or operably coupled to the ducting 44 so as to deliver air under a positive pressure into the interior 28 of each of the air chambers 24 and 26, as indicated by directional arrows 50. It should be noted that the specific number and location of the plurality of air outlets 46, 47 and 48 may, of course, vary dependent upon the size of the interior 28. As set forth above, a single outlet may be connected to the ducting 44 so as to direct air under pressure into the interior 28 of each of the air chambers 24 and 26. However, it is to be emphasized that the air distribution assembly, at least partially defined by the one or more outlets 46, 47 and 48, is disposed, structured and dimensioned to preferably distribute the air substantially evenly throughout the interior 28 of each of the air chambers 24 and 26 in a manner which facilitates the flow of air, under pressure from the interior 28, into both the interior 12 of the controlled room 10 and outwardly therefrom to the surrounding areas on the exterior of one air chambers 24 and 26. As set forth above, the substantially even distribution of air, although not required to be precisely even throughout the interiors 28, does better serve to establish concurrent paths of air flow 50' and 50" from each of the interiors 28 through the first and second passages 30 and 32, respectively, as will be explained in greater detail hereinafter.

Figure 5:
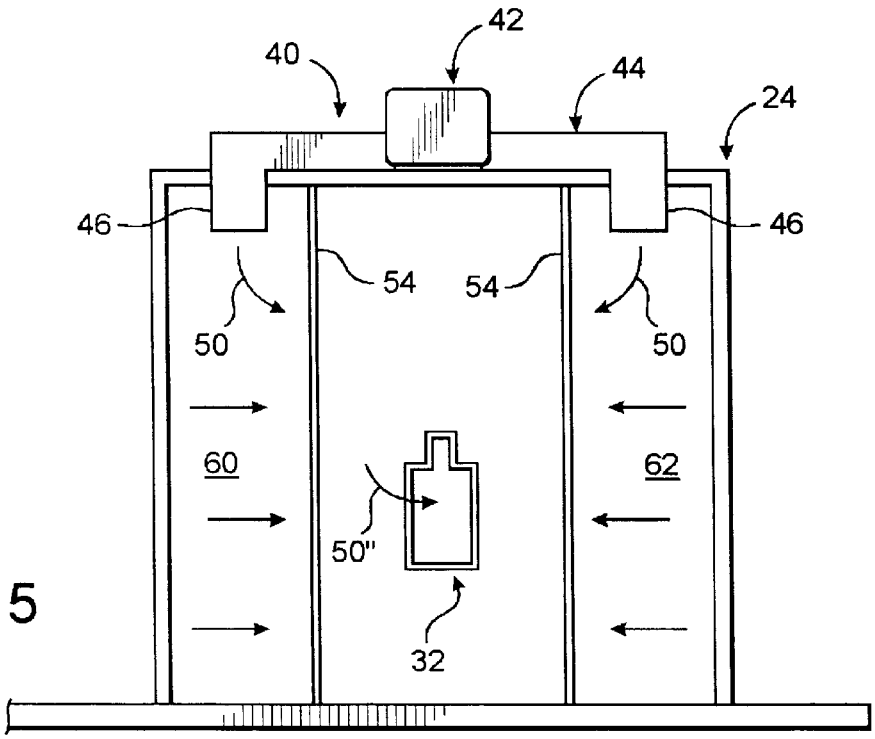
FIG. 5 is an interior view of the embodiment of FIG. 4.

The distribution assembly comprising one or more outlets 46, 47 and 48, as shown in the various Figures, may extend along opposite sides of each chamber 24 and 26. In addition, another preferred embodiment may also include a diffusion structure which is considered a part of the distribution assembly. The diffusion structure includes at least one, but preferably two spaced apart diffusion members 54 which, as best shown in FIG. 5, may be located in a preferred position on opposite sides of the path of the conveyor assembly 16 and the plurality of work products 14 passing through the interior 28 of each of the air chambers 24 and 26. Also in a preferred embodiment, each of the diffusion members 54 is defined by a panel or like member preferably having a planar configuration and an apertured construction that includes a plurality of spaced apart apertures 56, shown in FIG. 1, dimensioned and configured to allow the passage of air from corresponding ones of the outlets 46, 47 and 48 therethrough to the opposite side of each of the diffusion members 54. The diffusion members 54 facilitate the aforementioned substantially even distribution of air and the concurrent passage of air out through both of the first and second passages 30 and 32 of each of the air chambers 24 and 26, as indicated by the concurrent paths of air 50' and 50" under positive pressure. Each of the diffusion members 54 may extend along the entire length of the interior 28 of each of the air chambers 24 and 26 and may further extend from the floor 28' to the ceiling 28". By virtue of the dimension, disposition and configuration of each of the diffusion members 54, air plenum chambers 60 and 62 are defined and effectively segregated from the central portion of the interiors 28 along which the conveyor assembly 16 and work products 14 passes as they enter into and exit from the interior 12 of the controlled room 10. In the preferred embodiment, the plenum chambers 60 and 62 are located within the interior 28 of each of the chambers 24 and 26 and, as clearly shown in FIG. 5 communicate directly with the correspondingly disposed sets of the plurality of outlets 46, 47 and 48.

Accordingly, the cooperative structuring and disposition of the one or more outlets 46, 47 and 48 with the diffusion structure, comprising the spaced apart diffusion members 54, each having the aforementioned, preferably apertured construction 56, allows for a substantially even distribution of air 50 from the plurality of outlets 46, 47 and 48, and thereby, facilitates the creation and direction of the concurrent paths of air flow 50' and 50" which simultaneously pass through the first passage 30 and the second passage 32, of both the air chambers 24 and 26.

As set forth above, the passage of air flow along the path 50', under positive pressure, will be directed from each of the interiors 28, outwardly into the surrounding area located exteriorly of the controlled room 10 and each of the chambers 24 and 26. The concurrent path of air flow 50" will simultaneously pass through the second passage 32 from the interior 28 of each of the chambers 24 and 26, into the interior 12 of the controlled room 10. By virtue of these concurrent paths of air flow 50' and 50", contaminants will be eliminated or significantly reduced from entering into the interior 28 of each of the chambers 24 and 26, and accordingly, will be prevented from entering into the interior 12 of the controlled room 10. Concurrently, the passage of air 50" entering the interior 12 of the controlled room 10, will eliminate or significantly reduce the amount of conditioned air escaping from the interior 12 through the passage 32. Replacement of the "make-up" or conditioned air and the considerable energy costs normally associated therewith will also be eliminated or significantly reduced.

Figure 3:
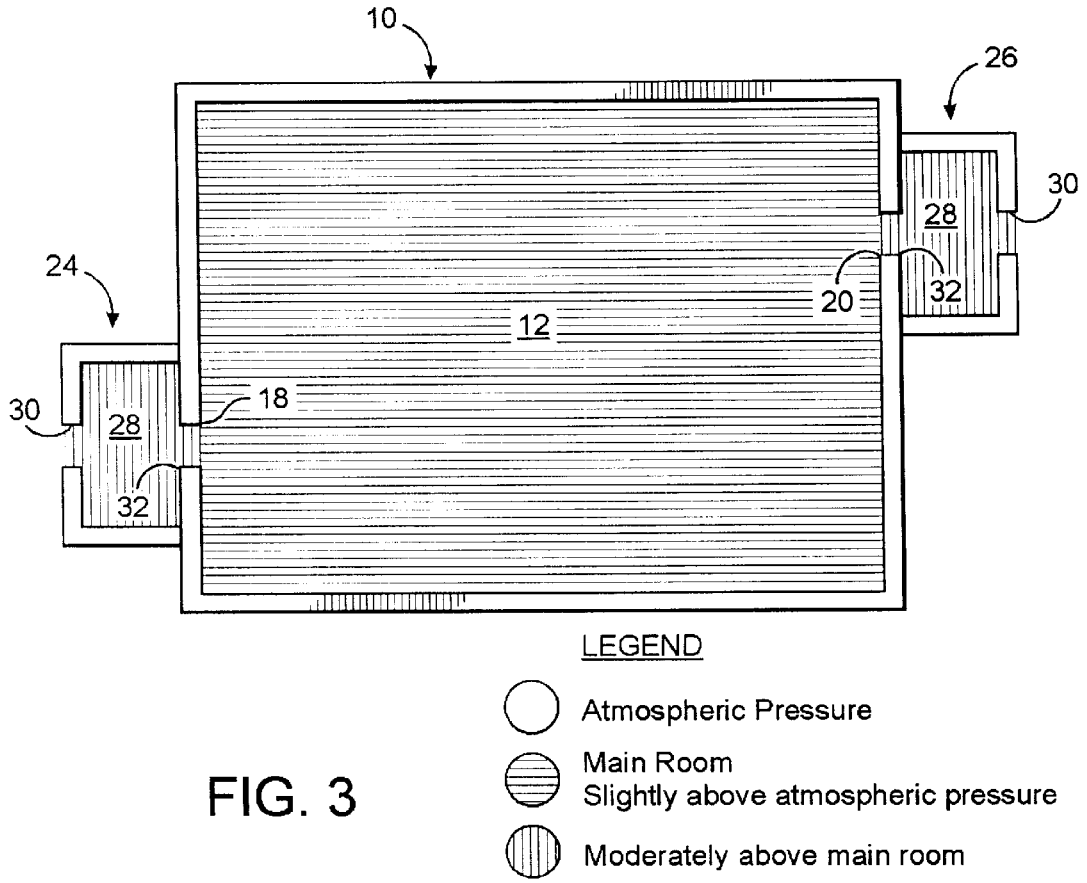
FIG. 3 is a top plan view of the preferred embodiment of FIG. 2 with an accompanying legend schematically indicating a variance in air pressure associated with the indicated structure.
Figure 4:
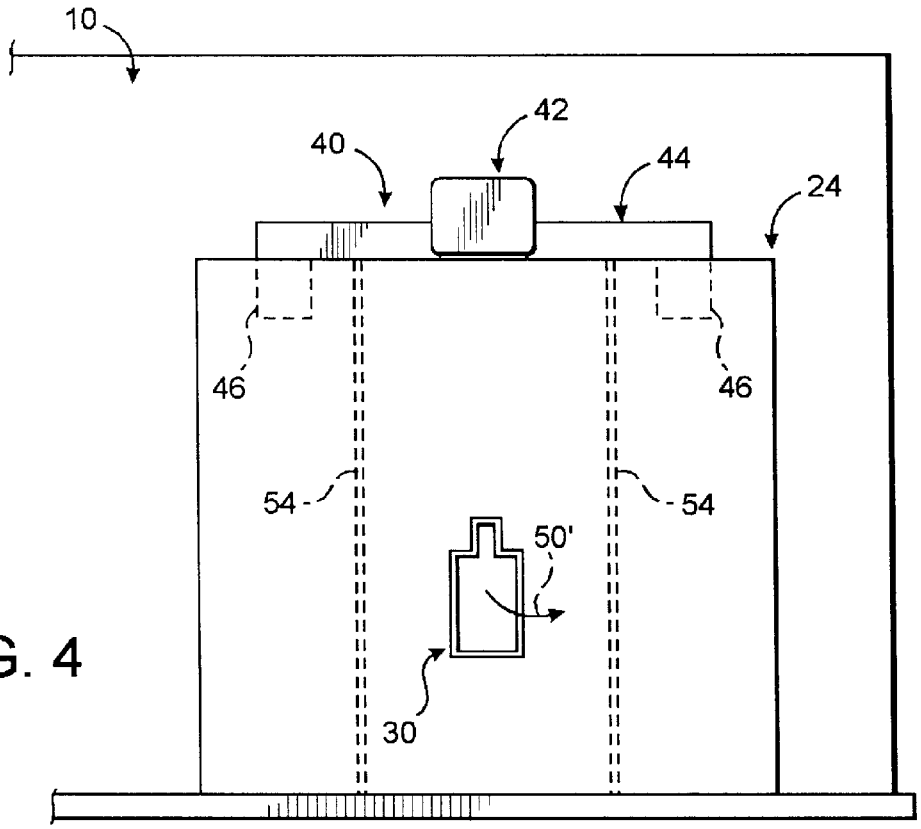
FIG. 4 is an exterior end view of one air chamber associated with the regulating assembly of the present invention.

With primary referenced to FIGS. 1, 3 and 5, an important feature of one embodiment of the present invention is the maintenance of specific pressures, and more in particular, pressure variations in each of the air chambers 24 and 26, relative to the pressure within the interior 12 of the controlled room 10. As indicated by the schematic representation of FIG. 3, the pressure of the surrounding areas located exteriorly of the controlled room 10, and the air chambers 24 and 26, is substantially at atmospheric pressure. The interior 12 of the controlled room 10 is maintained at a predetermined positive air pressure which is at least minimally greater than the atmospheric pressure of the surrounding exterior areas in order to aid in the prevention of contaminant material entering through the work product openings 18 and 20 or through any additional openings, such as one or more doors which may be provided to allow for the passage of personnel into and out of the interior 12 of the controlled environment room 10. Therefore, in order to accomplish concurrent channeling of the aforementioned paths of air flow 50' and 50", the air pressure within the interior 28 of each of the air chambers 24 and 26 is maintained at a predetermined positive pressure which is at least minimally greater than the air pressure within the interior 12 of controlled room 10. This minimally greater positive air pressure within the interiors 28 is accomplished by supplying air thereto at a sufficient rate and/or in sufficient quantities, from the air supply assembly 42, to force air flow along path 50", through the second passage 32 of each chamber 24 and 26 and through the contiguously disposed work product openings 18 and 20. Therefore, in order to overcome the positive pressure within the interior 12 of the control room 10, the air pressure within the interior 28 of each of the chambers 24 and 26 must be at least minimally greater, and preferably in the range of 0.01 inches to 0.03 inches on the conventional water gauge, to allow the air to pass along the path 50" into the interior 12. For purposes of explanation, the directional arrows 70 represent the greater positive pressure of air within the interior 28 of each of the chambers 24 and 26, and the directional arrow 72 represents the lesser, positive air pressure maintained within the interior 12 of the controlled room 10. The lesser atmospheric pressure is represented by directional arrow 74, on the exterior of the controlled room 10 and each of the air chambers 24 and 26. Accordingly, air from the surrounding environment is prevented from entering into the interiors 28 since the air traveling along the paths of travel 50' is significantly greater than atmospheric pressure. As set forth above, contaminant material will thereby be prevented or significantly restricted from entering through the first passage 30 of each of the positive air chambers 24 and 26.

Figure 6:
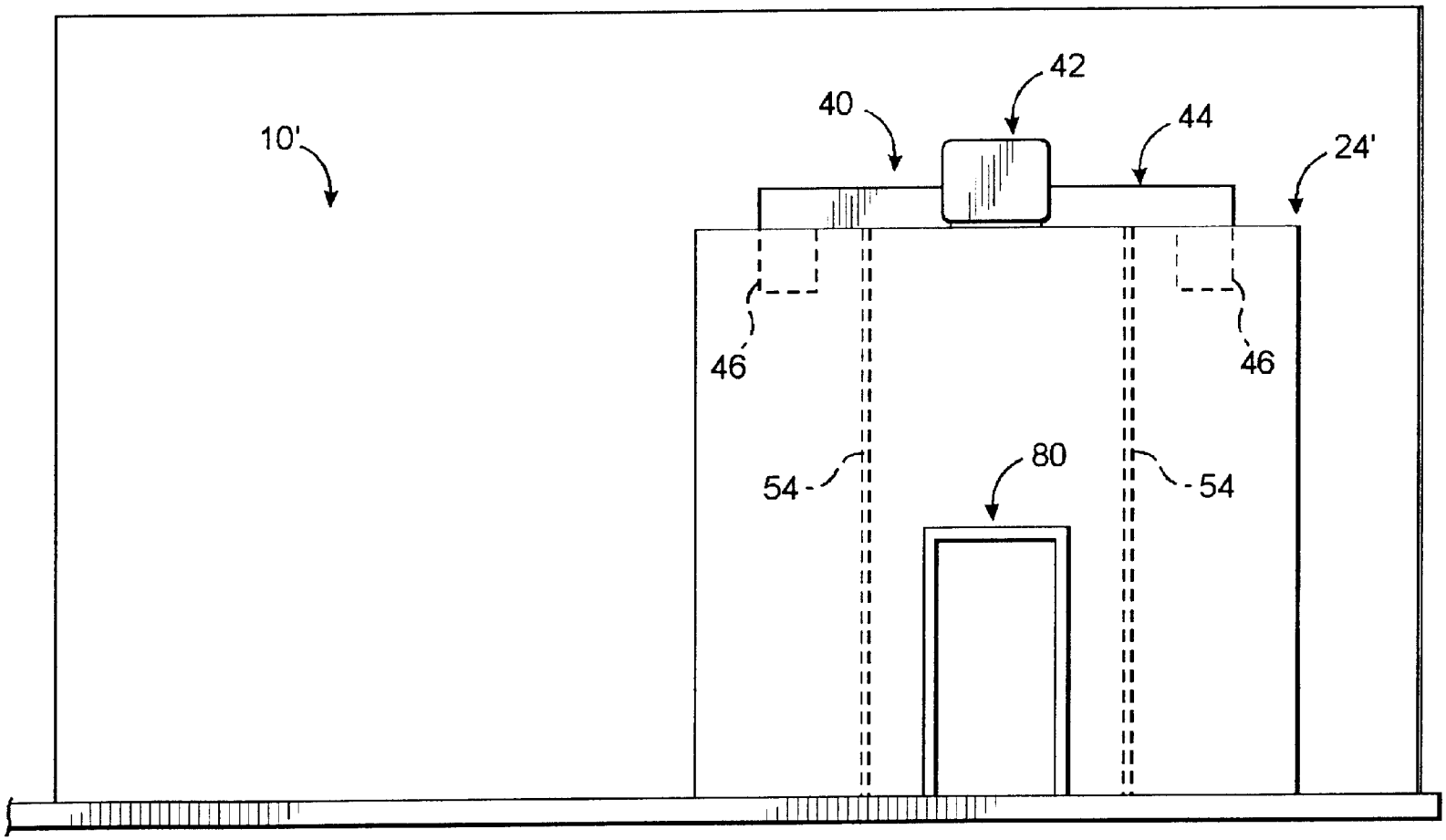
FIG. 6 is an exterior view of an air chamber comprising another preferred embodiment of the present invention.

Yet another embodiment of the present invention is represented in FIG. 6, wherein the controlled room 10' is not necessarily designed and structured to accomplish a powder coating application but is intended to be representative of other types of environment controlled rooms such as, but not limited to, large or even industrial sized cooler/freezers. In this category of controlled environment rooms, and possibly others, the prevention of significant amounts of conditioned air from exiting the interior thereof is of equal or even greater importance due to the extremely high cost involved in providing the energy to air conditioning assemblies capable of reducing the temperature as well as controlling the humidly of the air on the interior of the cooler/freezer type controlled environment room. Due to the oftentimes, extremely low temperatures at which such cooler/freezers are maintained, the substantial energy cost involved in the supplying of replacement or "make-up" air having an equally reduced temperature, would be eliminated or significantly reduced if the original air within the interior of the cooler/freezer were prevented from escaping through work product openings, doors, etc. In the embodiment of FIG. 6, a positive air pressure chamber 24' is disposed on the exterior of the controlled room 10' which is representative of a large, industrial sized cooler/freezer. An opening 80 is provided for the entry into the interior of the air chamber 24' and is sufficiently dimensioned and configured for the passage of personnel as well as for the travel and transport of products by large equipment, such as but not limited to, a forklift or the like. An additional opening (not shown) is oppositely disposed relative to the opening 80 and is provided to establish direct fluid communication between the interior of the positive air pressure chamber 24' and the interior of the controlled room in the form of a cooler/freezer 10'. Concurrent paths of air flow are established within the interior of the chamber 24' and cause air to simultaneously flow from the interior of the air chamber 24' through the opening 80 to the surrounding environment, as well as into the interior of the controlled room 10'. The air within the controlled room 10' being at a drastically reduced temperature is thereby prevented or significantly restricted from escaping. Therefore, "make-up" air having a similarly reduced temperature is no longer required to be supplied, at least in any significant quantities to the interior of the cooler/freezer or controlled environment room 10', resulting in substantial savings in energy costs associated therewith.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. An assembly for a controlled environment enclosure having at least one work product opening, said assembly comprising:

a) an air chamber mounted adjacent the enclosure and in fluid communication with an interior of the enclosure through the work product opening, b) a first passage formed in said air chamber and disposed in fluid communication between an interior of said air chamber and an exterior of the enclosure, c) a second passage formed in said air chamber and disposed in fluid communication between said air chamber interior and the enclosure interior, d) an air supply assembly communicating with said air chamber and structured to deliver a supply of air sufficient to define a predetermined positive air pressure within said air chamber interior, and e) said predetermined positive air pressure being at least minimally greater than the air pressure within the enclosure interior.

2. An assembly as recited in claim 1 wherein said air chamber is disposed and dimensioned to define concurrent paths of air flow from said air chamber interior to both the interior and exterior of the enclosure.

3. An assembly as recited in claim 2 wherein said concurrent paths of air flow comprise a first path of air flow from said air chamber interior to the exterior of the enclosure and being at least partially defined by said first passage.

4. An assembly as recited in claim 3 wherein said concurrent paths of air flow comprise a second path of air flow from said air chamber interior to the enclosure interior and being at least partially defined by said second passage.

5. An assembly as recited in claim 1 wherein said air chamber is mounted exteriorly of the enclosure and said second passage is disposed in contiguous relation to the work product opening of the enclosure.

6. An assembly as recited in claim 5 wherein said first passage is disposed in spaced relation to the enclosure and in direct communication with both the exterior of said air chamber and the exterior of the enclosure.

7. An assembly as recited in claim 2 further comprising a distribution assembly disposed downstream of said air supply assembly relative to said supply of air to said air chamber and structured to distribute air within said air chamber interior.

8. An assembly as recited in claim 7 wherein said distribution assembly comprises a diffuser structure mounted in fluid communication with said supply of air to said air chamber and disposed and configured to facilitate the directing of air along said concurrent paths of air flow.

9. An assembly as recited in claim 8 wherein said diffuser structure is mounted within said air chamber interior in receiving relation to said supply of air from said air supply assembly.

10. An assembly as recited in claim 9 wherein said diffuser structure comprises at least one panel having an apertured construction.

11. An assembly as recited in claim 7 wherein said distribution assembly comprises a plurality of outlets disposed in fluid receiving relation to said air supply assembly and mounted in spaced apart relation within said air chamber interior, said plurality of outlets disposed and structured to deliver air substantially evenly throughout said air chamber interior.

12. An assembly designed to control the introduction of contaminants into and restrict the escape of air from a controlled environment enclosure having a plurality of work product openings formed therein, said assembly comprising:

a) a plurality of air chambers equal in number to that of the work product openings, each of said air chambers mounted adjacent to the enclosure and in fluid communication with an interior of the enclosure through a different one of said openings, b) each of said air chambers including a first passage and a second passage each being dimensioned and configured to allow work product to pass therethrough, c) said first passage of each air chamber disposed in fluid communication between an interior of said air chamber and an exterior of the enclosure and said second passage of each air passage disposed in fluid communication between said air chamber interior and the interior of the enclosure, d) an air supply assembly communicating with said plurality of air chambers and structured to supply sufficient air thereto to define a predetermined positive air pressure within each of said plurality of air chambers, and e) said predetermined positive air pressure being at least minimally greater than the air pressure within the enclosure and sufficient to allow air to flow from each of said plurality of air chambers into the enclosure.

13. An assembly as recited in claim 12 wherein each of said plurality of air chambers is disposed and dimensioned to define concurrent paths of air flow therefrom to both the interior and exterior of the enclosure.

14. An assembly as recited in claim 13 wherein said concurrent paths of air flow of each of said plurality of air chambers comprise first and second paths of air flow from said air chamber interior through said first and second passages respectively.

15. An assembly as recited in claim 14 wherein said second passage of each of said plurality of air chambers is disposed in contiguous relation to a different one of the work product openings.

16. An assembly as recited in claim 12 wherein each of said plurality of air chambers is mounted exteriorly of the enclosure, and wherein said second passage of each of said plurality of air chambers is disposed in contiguous relation to a different work product opening of the enclosure.

17. An assembly as recited in claim 12 wherein each of said plurality of air chambers further comprises a distribution assembly disposed downstream of said air supply assembly relative to said supply of air thereto and being structured to distribute air to said interior of said air chamber.

18. An assembly as recited in claim 17 wherein said distribution assembly comprises a plurality of outlets disposed in fluid receiving relation to said air supply assembly and mounted in spaced apart relation and fluid communication with said interior of said air chamber.

19. An assembly as recited in claim 18 wherein said distribution assembly further comprises a diffuser structure mounted within said interior of each said air chambers and disposed and configured to facilitate the directing of air along concurrent paths of air flow from said interior of each of air chambers to both the interior and exterior of the enclosure.

20. An assembly as recited in claim 19 wherein said diffuser structure comprises at least one diffuser member having an apertured construction, said one diffuser member disposed in interruptive relation between at least some of said plurality of outlets and said first and second passages relative to air supplied to each of said air chambers from said air supply assembly.

21. An assembly as recited in claim 19 wherein said air diffuser structure comprises at least two diffuser members disposed in spaced apart relation to one another within each of said air chambers, each of said diffuser members comprising a planar configuration and an apertured construction and disposed in interruptive relation between at least some of said plurality of outlets and said first and second passages.

22. An assembly designed to control the introduction of contaminants into and restrict the exiting of air from a controlled environment enclosure having a plurality of work product openings formed therein, said assembly comprising:

a) a plurality of air chambers equal in number to that of the work product openings, each of said air chambers mounted exteriorly of the enclosure and in fluid communication with the enclosure interior through a different one of said openings, b) each of said air chambers including a first passage and a second passage each being dimensioned and configured to allow work product to pass therethrough, c) said first passage disposed in fluid communication between an interior of said chamber and an exterior of the enclosure and said second passage disposed in fluid communication between said air chamber interior and the interior of the enclosure, d) said second passage of each air chamber further disposed and dimensioned in contiguous, surrounding relation to a different one of the work product openings, e) an air supply assembly communicating with each of said plurality of air chambers and structured to supply sufficient air thereto to define a predetermined positive air pressure within each of said plurality of air chambers, f) each of said plurality of air chambers disposed and dimensioned to define concurrent paths of air flow therefrom to both the interior and exterior of the enclosure, g) said concurrent paths of said air flow of each of said plurality of air chambers comprising a first and a second paths of air flow from said chamber interior through said first and second passages respectively, and h) said predetermined positive air pressure being at least minimally greater than the air pressure within the enclosure to allow air to flow from each of said plurality of air chamber interior into the enclosure along said second paths of air flow.

* * * * *